United States Patent [19]

Ebstein et al.

[11] 4,005,860

[45] Feb. 1, 1977

[54] BASKETBALL BACKBOARD AND SUPPORT

[75] Inventors: John W. Ebstein, Roslyn Heights; Mario Cambardella, Manhasset, both of N.Y.

[73] Assignee: Diversified Products Corporation, Opelika, Ala.

[22] Filed: Mar. 17, 1975

[21] Appl. No.: 559,190

[52] U.S. Cl. ..... 273/1.5 R; 248/221.2

[51] Int. Cl.[2] ..... A63B 63/04

[58] Field of Search ..... 273/1.5 R, 102 S, 105 R, 273/105 A; 248/224, 300, 242, 281

[56] References Cited

UNITED STATES PATENTS

| | | | |
|---|---|---|---|
| 2,731,228 | 1/1956 | Baldwin | 248/300 |
| 2,831,689 | 4/1958 | Marsh | 273/1.5 R |
| 3,776,549 | 12/1973 | Ganis | 273/1.5 R |
| 3,802,702 | 4/1974 | Pulley | 273/1.5 R |

*Primary Examiner*—Paul E. Shapiro
*Assistant Examiner*—Marvin Siskind
*Attorney, Agent, or Firm*—Seidel, Gonda & Goldhammer

[57] ABSTRACT

A basketball backboard is provided with fastener members so that it may be quickly and easily suspended from notches on a mounting bracket. With the backboard thusly suspended from the bracket, nuts on the fastener members are tightened to secure the backboard to the bracket.

6 Claims, 3 Drawing Figures

FIG. 1
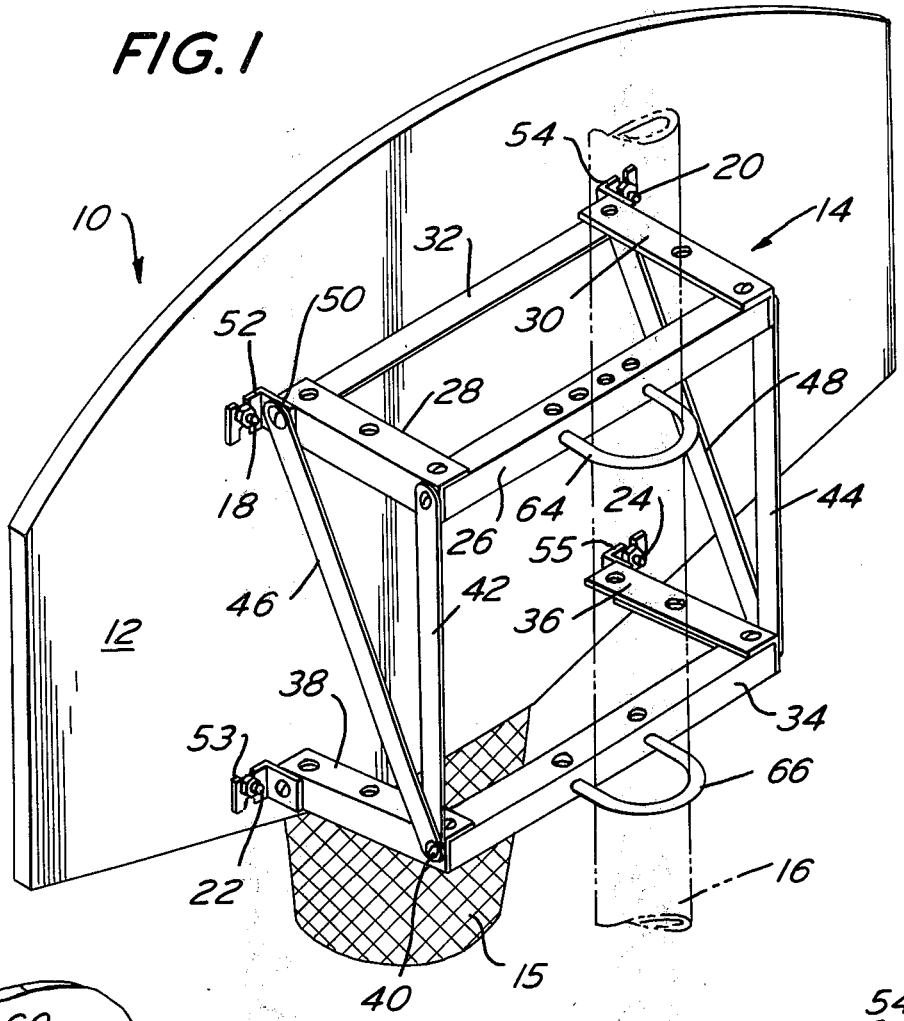
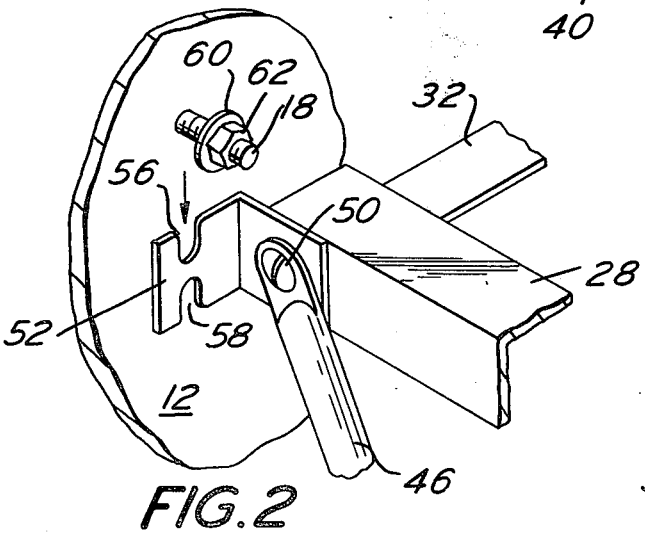
FIG. 2
FIG. 3
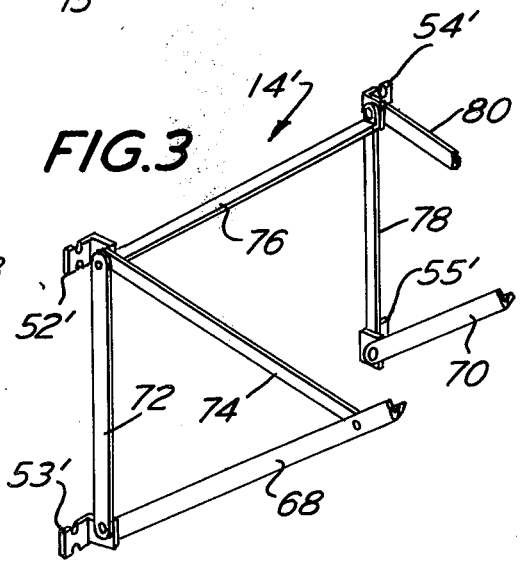

BASKETBALL BACKBOARD AND SUPPORT

BACKGROUND

A wide variety of brackets have been proposed heretofore in connection with mounting a basketball backboard to a support such as a pole, a wall, or a roof at the desired elevation above a playing surface. Such prior art devices usually are in the form of a kit which requires the components of the bracket to be assembled which usually requires a scissor-type arrangement. A scissor-type arrangement of brackets presents or involves a time consuming chore in orientating one bracket with respect to the other so that their ends are at the same elevation for securement to the backboard.

The present invention is directed to a basketball backboard and support. The backboard is adapted to have a net on one side. A bracket is provided for the other side of the backboard. The bracket is constructed in a manner so that it may facilitate mounting the backboard on a support at a desired elevation above a playing surface.

The backboard is provided with upper and lower pairs of bolts projecting therefrom and generally perpendicular thereto. The bracket is provided with upper and lower pairs of notches lying in a generally vertical plane and spaced a predetermined distance apart so that each notch may receive one of said bolts. A fastener is provided for each bolt for removably securing each bolt in its associated notch.

The structural interrelationship between the bracket and backboard as described above facilitates rapid coupling of the backboard to its mounting bracket. With the bracket attached to its support, such as a pole, roof, wall, or the like, it takes only a few seconds to simultaneously position each bolt in its associated notch. The weight of the backboard is thereby supported by the bracket. Hence, a fastener for each bolt may be tightened without the operator having to support or manipulate the backboard.

The bracket is preferably rectangular or box-like in shape to provide a rigid bracket wherein the notches are spaced apart a predetermined distance corresponding to the predetermined spacing of the mounting bolts preassembled to the backboard.

In addition to minimizing the assembly work by the person installing the backboard, the structural interrelationship of the bracket utilized in connection with the present invention minimizes cost of the same. Thus, the present invention facilitates use of L-shaped channel members instead of U-shaped channel members utilized in prior art devices. The notches are provided in small saddle brackets which are all identical with one another. Each saddle bracket has notches on opposite edges thereof so that it may be used as a right hand saddle bracket or a left hand saddle bracket. This construction minimizes inventory requirements while at the same time avoids the necessity of the person installing the unit to be cognizant of left and right hand brackets. Further, the saddle brackets minimize the need to machine other components of the bracket in connection with portions for attaching to the backboard.

It is an object of the present invention to provide a novel basketball backboard and support.

It is another object of the present invention to provide a basketball backboard and support bracket structurally interrelated in a manner which facilitates the ease and speed with which they may be coupled together for purposes of installation.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of the backboard and its support bracket.

FIG. 2 is an enlarged detailed view of the upper left corner of the bracket shown in FIG. 1.

FIG. 3 is a perspective view of an alternative bracket for the backboard shown in FIG. 1.

Referring to the drawing in detail, wherein like numerals indicate like elements, there is shown in FIG. 1 a basketball backboard and support in accordance with the present invention designated generally as 10. A backboard 12 which may be of conventional construction from a rigid material such as metal or a laminate is removably secured to the mounting bracket 14. For purposes of illustration, bracket 14 is of the pole type so that it may be removably secured to a vertical pole 16 at the desired elevation above a playing surface. The backboard 12 supports a net 15 on one side thereof, namely the playing side.

On the rear side of the backboard 12, as shown in FIG. 1, there is preassembled a plurality of fastener members such as bolts 18, 20, 22 and 24. Bolts 18 and 20 define an upper pair while bolts 22 and 24 define a lower pair. The bolts 18–24 are preferably carriage bolts. The bolts 18–24 are generally perpendicular to the backboard 12.

The mounting bracket 14 is generally rectangular or boxlike when viewed in top plan and/or in elevation. The bracket 14 is preferably preassembled and attached to the support such as pole 16 before the backboard 12 is removably attached thereto. The bracket 14 includes a mounting brace 26 which is preferably of angle configuration such as a L-shaped member in section and made from metal. Similarly shaped arm members 28 and 30 have one end secured to the brace 26 and project forwardly therefrom. The free end of said arm members 28 and 30 are interconnected by a horizontal strap 32 thereby defining a rigid rectangular configuration when viewed from above.

A second mounting brace 34 is parallel to and spaced from the brace 26. Arm members 36 and 38 are secured to the brace 34 and project forwardly therefrom. The arm members 36, 38 are parallel to and of the same length as the arm members 28, 30. Brace 34 and arm members 36, 38 are preferably made of the same material and are of the same configuration as the brace 26.

The arm members 36 and 38 are not interconnected at their free ends. Arm member 38 is secured to the brace 34 by a fastener 40. A similar fastener is provided for the arm member 36. Arm member 38 may pivot slightly in a downward direction about the axis of fastener 40. Likewise, arm member 36 may pivot slightly. Such slight pivotable movement for the arm members 36 and 38 will be made clear hereinafter.

The arm members 28 and 38 are vertically interconnected by a vertical strap 42 having a length generally corresponding to the distance between the bolts 18 and 22. A similar vertical strap 44 interconnects the arm members 30 and 36. The length of the strap 44 generally corresponds to the distance between the bolts 20 and 24. Arm members 28 and 38 are also interconnected by the diagonal strap 46. Arm members 30 and 36 are also interconnected by the diagonal strap 48.

One end of the diagonal strap 46, namely the upper end in FIG. 1, is connected to an end of arm member 28 by a fastener 50. The fastener 50 also secures a saddle bracket 52 to the arm member 28. See FIG. 2. In like manner, a saddle bracket 54 is secured to the arm member 30 at the end thereof remote from the brace 26. The saddle brackets 52 and 54 project in opposite directions away from their respective arm members and have notches 56 and 58 lying in a generally vertical plane so as to be generally parallel to the backboard 12 with the notches spaced apart by a distance corresponding to the spacing between the bolts 18 and 20.

The saddle bracket 53, comparable to bracket 52, is secured to the free end of arm member 38. A similar saddle bracket 55 is connected to the free end of arm member 36. Each of the saddle brackets 52–55 are identical so as to eliminate the need for right and left hand brackets. Only one of the notches 56, 58 will be used. Thus, notch 56 on saddle bracket 52 is adapted to receive the bolt 18. On bracket 54, it is the notch 58 which is adapted to receive the bolt 20.

Each of the bolts 18–24 has a washer 60 and a nut 62 spaced from the juxtaposed surface of the backboard 12 on a threaded portion of the bolt. The distance between the backboard 12 and the washer 60 is at least as large as the thickness of the saddle bracket 52.

The brace members 26 and 34 are provided with means for securing the bracket 14 to a support. When the support is in the form of a pole such as pole 16, the attaching means may take the form of the U-shaped bolts 64, 66 removably secured to the braces 26, 34, respectively, as shown in FIG. 1.

The preassembled bracket 14 is attached to the support at the desired elevation above a playing surface. Such mounting generally involves positioning the bracket 14 so that the brace 34 is about 9–10 feet above the playing surface which may be a floor in a building or a paved surface on the ground constituting part of an outdoor playing court.

The backboard 12 is then lifted and the bolts 18 and 20 positioned in their respective notches on the saddle brackets 52, 54. The arm members 36, 38 are preferably pivoted to a slight angle of about 5–10° below the horizontal prior to the mounting of the backboard 12 on the saddle brackets 52, 54. Thereafter, arm members 36 and 38 are pivoted upwardly to a horizontal position so that the bolt 22 is received in the notch on saddle bracket 53 while the bolt 24 is received in the notch on the saddle bracket 55. Such pivotable movement of arm members 36, 38 is not essential but is desirable since it insures proper orientation notwithstanding slight deviations from manufacturing tolerances. Thereafter, the nut 62 on each bolt is tightened to thereby complete the installation of the backboard 12.

It will be noted that the person installing the backboard 12 need not support the same as soon as the bolts 18 and 20 are received in their respective notches on the saddle brackets 52, 54. As a result thereof, the person installing the backboard is free to use both hands for tightening the nuts 62. The saddle brackets 52, 54 are always spaced a uniform distance apart and their respective notches lie in a vertical plane for quickly and easily receiving the bolts 18, 20 respectively.

In FIG. 3, there is illustrated an alternative embodiment for the bracket, namely bracket 14′. The bracket 14′ is designed for installing the backboard 12 on a support such as an angled roof. The bracket 14′ includes mounting braces 68 and 70 which are parallel to one another and L-shaped in section. One of the angled portions of braces 68 and 70 is provided with holes for nailing or otherwise securing the braces to the roof.

A vertical strap 72 has one end secured to brace 68. A diagonal strap 74 has one end secured to the brace 68. The other ends of the straps 72, 74 are connected together by a fastener which also secures therebetween the saddle bracket 52′. Bracket 52′ is identical with bracket 52.

The fastener securing the lower end of the vertical strap 72 to the brace 68 also secures therebetween a portion of the saddle bracket 53′. Bracket 53′ is identical with bracket 53. The vertical strap 72 has a length corresponding generally to the length of strap 42 which in turn corresponds generally to the distance between the bolts 18 and 22.

The brace 70 is connected to a vertical strap 78 and a diagonal strap 80 in the same manner as described above in connection with straps 72, 74, and brace 68. A horizontal strap 76 extends between the vertical strap 72, 78. A saddle bracket 54′, corresponding to bracket 54, is provided at the upper right hand corner of the bracket 14′. Likewise, a saddle bracket 55′, corresponding to bracket 55, is provided in the lower right hand corner of the bracket 14′. See FIG. 3. The bracket 14′ is utilized in the same manner as described above other than the fact that it is used for securing the backboard 12 to an angled roof.

When it is desired to secure the bracket 14 to a vertical surface such as a wall, fasteners are utilized in a manner so that they extend through the holes in the braces 26, 34 which are presently occupied by the U-bolts 64, 66 respectively.

The present invention may be embodied in other specific forms without departing from the spirit or essential attributes thereof and, accordingly, reference should be made to the appended claims, rather than to the foregoing specification as indicating the scope of the invention.

We claim:

1. Apparatus comprising a basketball backboard having a net on one side thereof, a mounting bracket for mounting said backboard on a support at a desired elevation above a playing surface, said backboard having a pair of fastener members generally perpendicular thereto and projecting from an upper portion of said other side of said backboard, said mounting bracket having a pair of saddle brackets, each saddle bracket having a notch on its upper edge, each notch lying in a generally vertical plane which is generally parallel to said backboard, said notches being spaced apart by a distance corresponding to the distance between said pair of bolts so that each notch may receive one of said bolts, said mounting bracket having at least one more saddle bracket below the elevation of said first mentioned saddle brackets, said third mentioned saddle bracket having a notch lying in the same plane as said first and second mentioned saddle bracket notches, said backboard having at least one more bolt projecting from said other surface and generally perpendicular thereto in a location so that it may be received in the notch on said third saddle bracket, said mounting bracket including a vertically disposed strap having a length corresponding generally to the vertical distance between the location of said third bolt and a line extending between said first and second bolts, and said mounting bracket including at least one brace having means thereon for securing the mounting bracket to a support.

2. Apparatus in accordance with claim 1 wherein said saddle brackets are discrete L-shaped brackets having a notch on opposite edges.

3. Apparatus in accordance with claim 2 wherein said mounting bracket including a brace, an angularly disposed strap on said mounting bracket secured at its upper end to one of said saddle brackets by a single fastener, and said brace having means thereon for attaching the mounting bracket to a support.

4. Apparatus comprising a basketball backboard adapted to have a net on one side, a mounting bracket for cooperation with the other side of said backboard for mounting the same on a support at a desired elevation above a playing surface, said backboard having upper and lower pairs of bolts projecting therefrom and generally perpendicular thereto, said mounting bracket including a vertically exposed strap on each side thereof, each said vertical strap having a length corresponding generally to the distance between an upper bolt and a lower bolt on said backboard, a discrete fastener for each bolt, each said fastener being spaced from the backboard so as to leave an exposed portion of each bolt, said bracket having upper and lower pairs of peripheral notches lying in a generally vertical plane and spaced a predetermined distance apart corresponding to the spacing of said bolts so that each notch may receive an intermediate exposed portion of said bolts as the bolts are lowered into the notches whereby the backboard may be suspended from said bracket prior to tightening of said fasteners.

5. Apparatus in accordance with claim 4 wherein said bracket is rectangular in plan view defined by parallel arm members extending toward the backboard and interconnected by one end by a strap adjacent the backboard and by a brace at their other ends, said brace having means for securing said bracket to a support.

6. Apparatus comprising a basketball backboard having a net on one side thereof, a mounting bracket for mounting said backboard on a support at a desired elevation above a playing surface, said backboard having upper and lower pairs of bolts projecting therefrom and generally perpendicular thereto, said mounting bracket including upper and lower pairs of L-shaped brackets having a notch on upper and lower edges and where upper and lower pairs of notches lie in a generally vertical plane spaced a predetermined distance apart corresponding to the spacing of said bolts so that each upper and lower pairs of notches may receive one of said bolts, and a fastener for each bolt for securing each bolt in its associated notch, said mounting bracket also including a brace, an angularly disposed strap on said mounting bracket and secured to one of said L-shaped brackets by a single fastener, and said brace having means thereon for attaching the mounting bracket to a support.

* * * * *